US006295430B1

(12) United States Patent
Kang

(10) Patent No.: US 6,295,430 B1
(45) Date of Patent: Sep. 25, 2001

(54) DRYING UNIT COUPLING APPARATUS OF LIQUID ELECTROPHOTOGRAPHIC PRINTER

(75) Inventor: Dong-hwan Kang, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/629,799

(22) Filed: Jul. 31, 2000

(30) Foreign Application Priority Data

Aug. 20, 1999 (KR) ..... 99-34577

(51) Int. Cl.[7] ..... G03G 15/10
(52) U.S. Cl. ..... 399/249; 399/348; 399/251
(58) Field of Search ..... 399/57, 233, 237, 399/249, 251, 348, 357, 358

(56) References Cited

U.S. PATENT DOCUMENTS 5,884,127 * 3/1999 Kim et al. ..... 399/249
6,219,500 * 4/2001 Byun ..... 399/57
6,219,512 * 4/2001 Saitoh ..... 399/249

* cited by examiner

*Primary Examiner*—Sophia S. Chen
*Assistant Examiner*—Hoan Tran
(74) *Attorney, Agent, or Firm*—Sughrue, Mion, Zinn, Macpeak & Seas, PLLC

(57) ABSTRACT

A drying unit coupling apparatus of a liquid electrophotographic printer in which the engagement of a driving gear installed at a main frame, and a driven gear installed at a cam shaft, are prevented from disengaging when an auxiliary frame supporting the cam shaft is coupled to the main frame. The driven gear is engaged with the driving gear when the auxiliary frame and the main frame are coupled. The apparatus includes a main frame where a driving roller supports a circulating photoreceptor medium, a driving gear installed at the main frame, an auxiliary frame which is slidably installed at the main frame, a cam shaft supported at the auxiliary frame, a drying unit, a driven gear installed at the cam shaft, a cam member installed at the cam shaft, and a position fixing mechanism which fixes the position of the cam shaft when the driving gear and the driven gear are engaged, preventing the driving gear and the driven gear from deviating from each other. The drying unit includes a drying roller for absorbing a liquid carrier remaining on the photoreceptor medium, a heating roller for heating the drying roller, and a separation plate and a contact plate, all installed in a drying unit frame. The cam member selectively pushes the separation plate or the contact plate so that the drying unit frame closely contacts or separates from the main frame.

18 Claims, 9 Drawing Sheets

DRYING UNIT COUPLING APPARATUS OF LIQUID ELECTROPHOTOGRAPHIC PRINTER

BACKGROUND OF THE INVENTION

1. Field of the Invention

The present invention relates to a drying unit coupling apparatus of a liquid electrophotographic printer.

2. Description of the Related Art

In general, a liquid electrophotographic printer such as a color laser printer or copying machine, as shown in FIG. 1, includes a developing unit 20 for developing a predetermined image on a photoreceptor medium 10 such as a photoreceptor web endlessly circulating, a drying unit 30 for drying liquid solution (hereinafter, referred to as carrier) remaining on the developed photoreceptor medium 10, and a transferring unit 40 for transferring the developed image on the photoreceptor medium 10 to a sheet of paper S.

The drying unit 30 includes a drying roller 31 for absorbing the carrier remaining on the photoreceptor medium 10 as drying roller 31 rotates in contact with the photoreceptor medium 10, and heating rollers 32 for vaporizing the carrier absorbed by the drying roller 31 by applying heat.

Here, during printing, the photoreceptor medium 10, the drying roller 31 and the heating rollers 32 are driven in close contact with one another, as shown in the drawing. When driven, the drying roller 31 and the heating rollers 32 absorb and vaporize the carrier, respectively. Meanwhile, when printing is not performed for a long time, the photoreceptor medium 10, the drying roller 31 and the heating rollers 32 need to be separated from one another. Also, in a printing-ready mode before printing begins, it is necessary to preheat the drying roller 31 to save the time needed for it to warm up. For preheating, in the printing-ready mode, the drying roller 31 is separated from the photoreceptor medium 10 and rotated by being in close contact with the heating rollers 32. Thus, in the drying unit 30, the drying roller 31 and the heating roller 32 are allowed to move within a range of a predetermined distance according to a printing mode, a printing-ready mode and a stop mode.

The photoreceptor medium 10 circulates by being wound around a driving roller 12 and rollers 14 and 15, and its surface is uniformly charged by a charger 18. A laser scanning unit 22 scans a laser beam onto the charged photoreceptor medium 10 according to a desired printing image. The surface of the photoreceptor medium 10 is selectively exposed to the scanned laser beam to form an electrostatic latent image. The electrostatic latent image is developed by developer adhering thereto, which is provided by the developing unit 20. The developed developer is squeezed by the developing unit 20 and dried by the drying unit 30, to thus form a desired image. The dried image is transferred to a sheet of paper S via the transferring roller 42 of the transferring unit 40.

However, according to the conventional technology, when the photoreceptor medium 10 or the drying unit 30 needs repairing or replacement, performing repair or replacement is not possible in the state in which the drying roller 31 is separated a predetermined distance from the driving roller 12, that is, in a stop mode. Also, since the drying unit 30 is formed of a single assembly, in order to perform the above works, the entire drying unit 30 must be disassembled and the drying roller 31 detached from the driving roller 12 or a main frame, which inconveniences a user. Accordingly, for the replacement of the photoreceptor medium or the repairing and replacement of the drying unit, more distance between the drying roller 31 and the photoreceptor medium 10 is needed than in a stop mode.

To overcome the above problem, an apparatus for separating a drying unit frame (where the drying roller is installed) a predetermined distance from the main frame (where the driving roller is installed) by using a cam member has been suggested in Korean Patent Application No. 98-44191. In the apparatus, a pair of gears are installed at the main frame and a cam shaft to correspond to each other and be meshed with each other when the main frame and an auxiliary frame, which supports the cam shaft, are coupled to each other. Thus, as the engaged gears rotate, the cam member pushes the drying unit frame in one direction so that the drying unit frame can be separated from or approach the main frame.

In the above apparatus, the gears stay engaged while an operation is performed in each of a stop mode, a printing-ready mode and a printing mode. However, when the engagement of the gears become loose due to movement of the drying unit or if the gears become improperly engaged, the gears may be damaged or an error may occur in the distance that the drying unit is separated from the main frame. Thus, it is necessary to constantly maintain the engagement of the gears when the drying unit is in close contact with the main frame.

SUMMARY OF THE INVENTION

To solve the above problems, it is an objective of the present invention to provide a drying unit coupling apparatus of a liquid electrophotographic printer having an improved structure in which the engagement of the driving gear installed at the main frame and the driven gear installed at the cam shaft are prevented from disengaging when the auxiliary frame is coupled to the main frame.

Accordingly, to achieve the above objective, there is provided a drying unit coupling apparatus of a liquid electrophotographic printer, which comprises a main frame where a driving roller for supporting a photoreceptor medium operative to circulate is supported, a driving gear installed at the main frame, a cam shaft supported at an auxiliary frame which is slidably installed at the main frame, a drying unit frame where a drying roller for absorbing a liquid carrier remaining on the photoreceptor medium, a heating roller for heating the drying roller, and a separation plate and a contact plate are installed, a driven gear installed at the cam shaft and engaged with the driving gear when the auxiliary frame and the main frame are coupled, a cam member, installed at the cam shaft, for selectively pushing the separation plate or the contact plate so that the drying unit frame closely contacts or separates from the main frame, and a position fixing means for fixing the position of the cam shaft in a state of the driving gear and the driven gear being engaged, to prevent the driving gear and the driven gear from deviating from each other.

It is preferred in the present invention that the position fixing means comprises a position fixing bar extended from a rotation shaft of the driving gear, a slider, slidably installed at the cam shaft, having a position determination hole into which the position fixing bar is inserted, and a coupling/releasing means for coupling and releasing the position determination hole and the position fixing bar by selectively moving the slider.

Also, it is preferred in the present invention that the coupling/releasing means comprises a spring, installed at the cam shaft, for elastically pressing the slider so that the position determination hole is separated from the position fixing bar, and a pivot unit, installed at the auxiliary frame to be capable of pivoting, for pushing the slider toward the position fixing bar so that the position determination hole and the position fixing bar are coupled to each other.

Also, it is preferred in the present invention that the pivot unit comprises a support shaft rotatably installed at the auxiliary frame, a pivot member, fixed to the support shaft, having an inclined surface to contact the slider so as to push the slider toward the position fixing bar during rotation, and a handle lever, fixed to the support shaft and installed at a handle lever installation portion formed by penetrating the auxiliary frame to enable the handle lever to pivot with respect to the auxiliary frame.

Also, it is preferred in the present invention that a stopper portion is formed at the pivot member to be stepped, to limit a pivoting range of the pivot member by hooking one side of the slider.

Also, it is preferred in the present invention that the drying unit coupling apparatus further comprises a posture fixing means for fixing the posture of the slider to prevent the position fixing bar and the position determination hole from deviating from each other.

Also, it is preferred in the present invention that the posture fixing means comprises a posture fixing hole formed in the slider, and a posture fixing bar, installed at the auxiliary frame and slidably coupled to the posture fixing hole.

Also, it is preferred in the present invention that the drying unit coupling apparatus further comprises a locking means for locking the auxiliary frame and the main frame together when the position fixing bar and the position determination hole are coupled to each other.

Also, it is preferred in the present invention that the locking means comprises a coupling pin installed to protrude from one side of the main frame, and a coupling groove, formed in the pivot unit and into which the coupling pin is inserted, the coupling groove pivoting when the pivot unit pivots by being coupled to the coupling pin.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
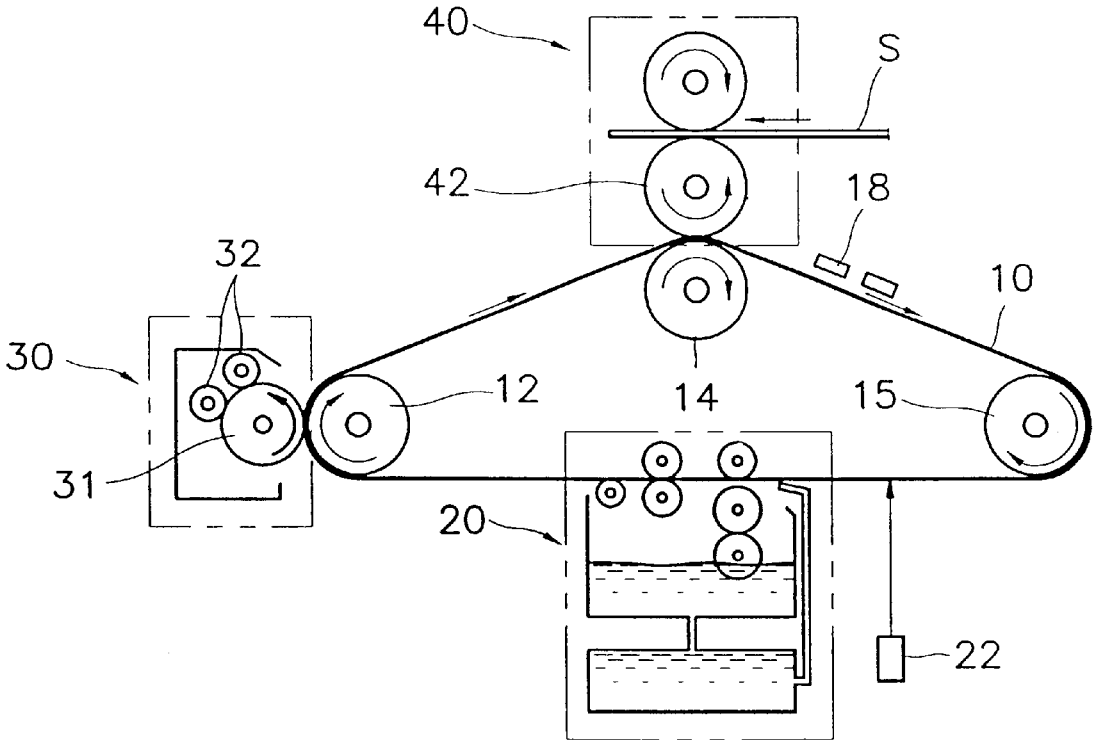
FIG. 1 is a view showing the structure of a general liquid electrophotographic printer.
Figure 2:
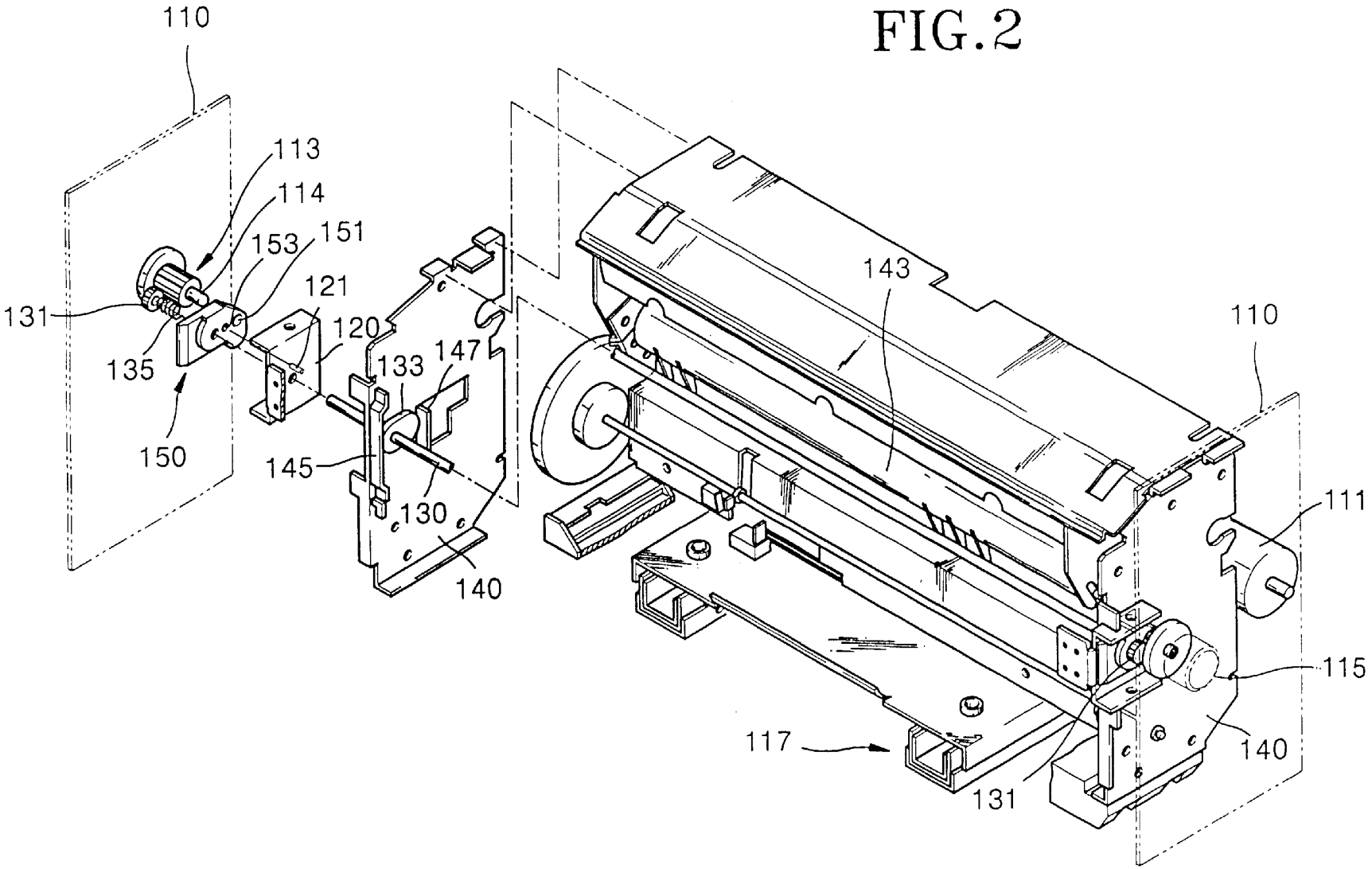
FIG. 2 is a partially cut-away and exploded perspective view showing major portions of a drying unit of a liquid electrophotographic printer according to a preferred embodiment of the present invention.
Figure 3:
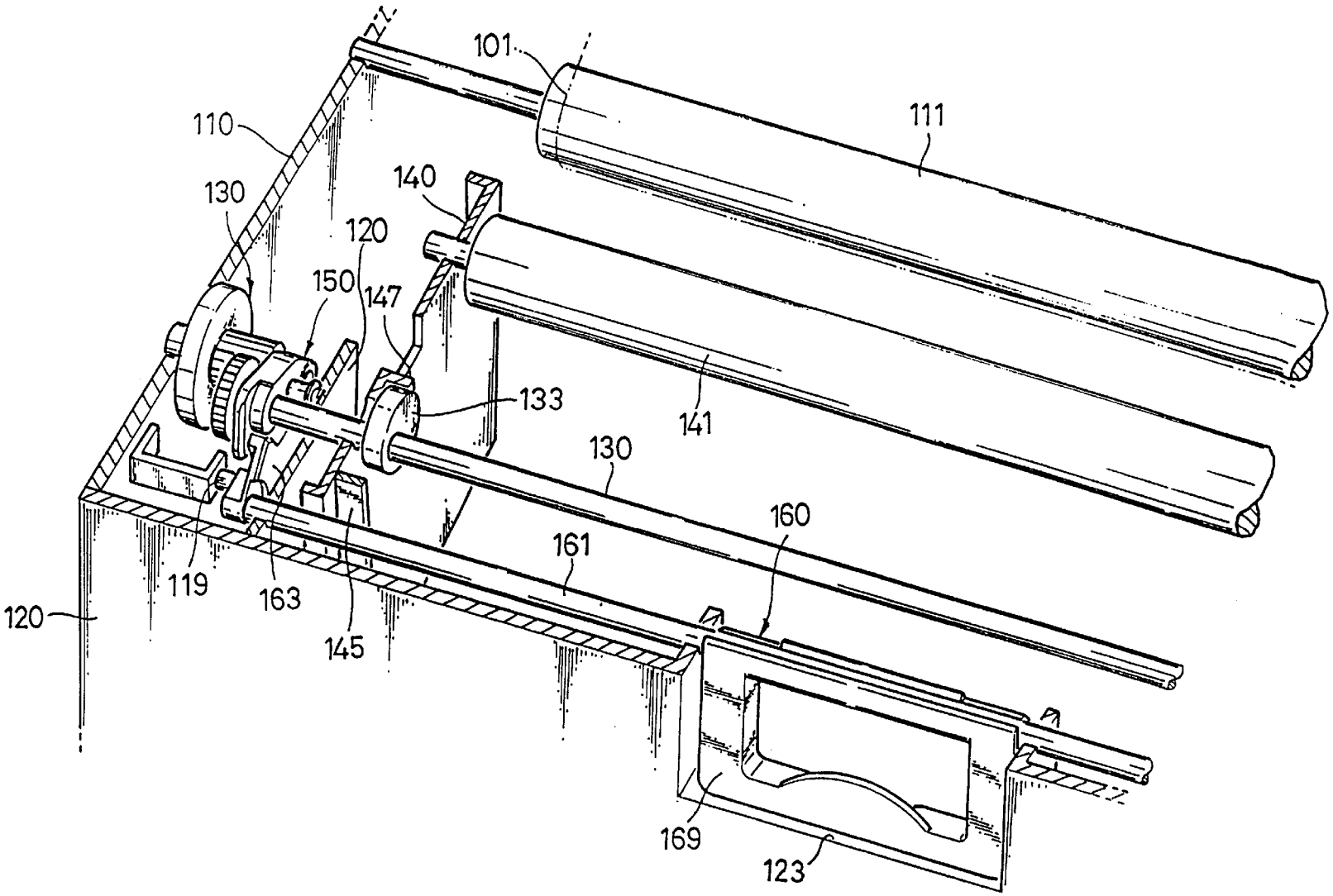
FIG. 3 is a perspective view partially showing portions of FIG. 2.
Figure 4:
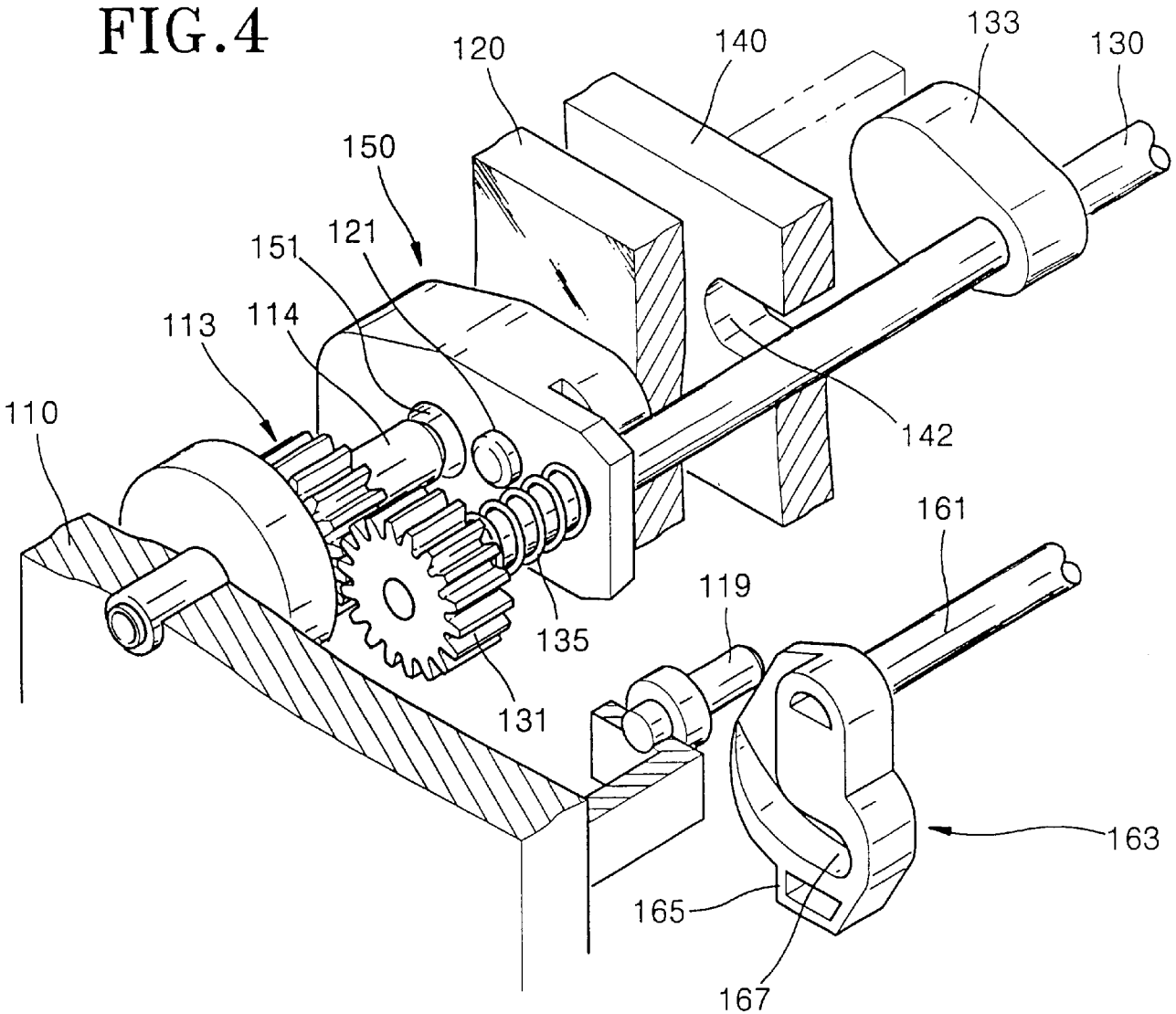
FIG. 4 is a magnified perspective view showing portions of FIG. 3.

FIG. 2 is a partially cut-away and exploded perspective view showing the portions of the drying unit coupling apparatus according to a preferred embodiment of the present invention. FIGS. 3 and 4 are perspective views showing the major portions of FIG. 2. In particular, FIG. 3 shows a state of a slider being coupled to a position fixing bar and FIG. 4 shows a state of the slider being separated from the position fixing bar.

Referring to FIGS. 2, 3 and 4, the drying unit coupling apparatus according to a preferred embodiment of the present invention includes a main frame 110 where a driving roller 111 is installed, a driving gear 113 installed at the main frame 110, a cam shaft 130 installed at an auxiliary frame 120 which is slidably coupled to the main frame 110, a drying roller 141, a drying unit frame 140 where a heating roller 143 for heating the drying roller 141 is installed, a driven gear 131 and a cam member 133 installed at the cam shaft 130, and a position fixing mechanism.

The main frame 110 corresponds to a main body of the printer, in which a plurality of rollers (not shown) including the driving roller 111, around which a photoreceptor medium 101 endlessly circulating is wound, are installed. Also, the driving gear 113 is rotatably installed at the main frame 110. The driving gear 113 is manually or automatically rotated by a handle 115 or a driving source (not shown). A rail assembly 117 which moves in a telescopic manner is installed at the lower portion of the main frame 110. The rail assembly 117 supports the auxiliary frame 120 and the drying unit frame 140 so as to be slidably coupled to the main frame 110.

The cam shaft 130 is installed at the auxiliary frame 120 to be capable of rotating via a bearing (not shown) by penetrating a slot 142 formed in the drying unit 140. Here, the cam shaft 130 may be installed to be capable of pivoting through a predetermined angle bounded by a stopper (not shown). Also, the driven gear 131 and the cam member 133 are installed at the cam shaft 130. The driven gear 131 is installed at an end portion of the cam shaft 130 so as to be rotated by being meshed with the driving gear 113 when the auxiliary frame 120 is coupled to the main frame 110.

The cam member 133 is installed to be in contact with the drying unit frame 140 to move the drying unit frame 140 so that it separates from or closely contacts the main frame 110 during rotation of the cam shaft 130.

The auxiliary frame 120 supporting the cam shaft 130 is coupled to the main frame 110 to be capable of sliding on the rail assembly 117. Also, the auxiliary frame 120 is integrally formed with the drying unit frame 140 so that it can be coupled to or separated from the main frame 110 by the rail assembly 117. Further, a position fixing bar 121 which will be described later is installed at the auxiliary frame 120.

A separation plate 145 and a contact plate 147 are installed at the drying unit frame 140. The cam member 133 is disposed between the two plates 145 and 147. As one of the plates 145 and 147 is pushed by the rotating cam member 133, the drying unit frame 140 can be separated from or positioned in close contact with the main frame 110 and the auxiliary frame 120. Here, the distance that the drying unit frame 140 is separated from the main frame 110 may be about 12 mm in a stop mode while the distance that the drying unit frame 140 closely contacts the main frame 110 may be about 3 mm in a printing-ready mode or a printing mode.

The position fixing mechanism is for fixing the position of the cam shaft 130 to constantly maintain the state in which the driving gear 113 and the driven gear 131 are engaged with each other when the auxiliary frame 120 is coupled to the main frame 110. The position fixing mechanism includes a position fixing bar 114 extending on a rotation shaft of the driving gear 113, a slider 150 having a position determination hole 151 into which the position fixing bar 114 is inserted, and a coupling/releasing mechanism for selectively performing coupling/releasing of the position fixing bar 114 to/from the position determination hole 151.

The position fixing bar 114 corresponds to a fixed shaft of the driving gear 113, and an end portion thereof is tapered so that it can be easily inserted into the position determination hole 151.

The slider 150 is installed at the cam shaft 130 to be capable of moving a predetermined distance. Also, in addition to the position determination hole 151, a posture fixing hole 153 which will be described later is formed in the slider 150.

The coupling/releasing mechanism includes a spring 135 for applying pressure to push the slider 150 away from the position fixing bar 114, and a pivot unit 160 for pushing the slider 150 toward the position fixing bar 114 by rotation. The spring 135 is installed around the cam shaft 130 to be disposed between the driven gear 131 and the slider 150.

Figure 5:
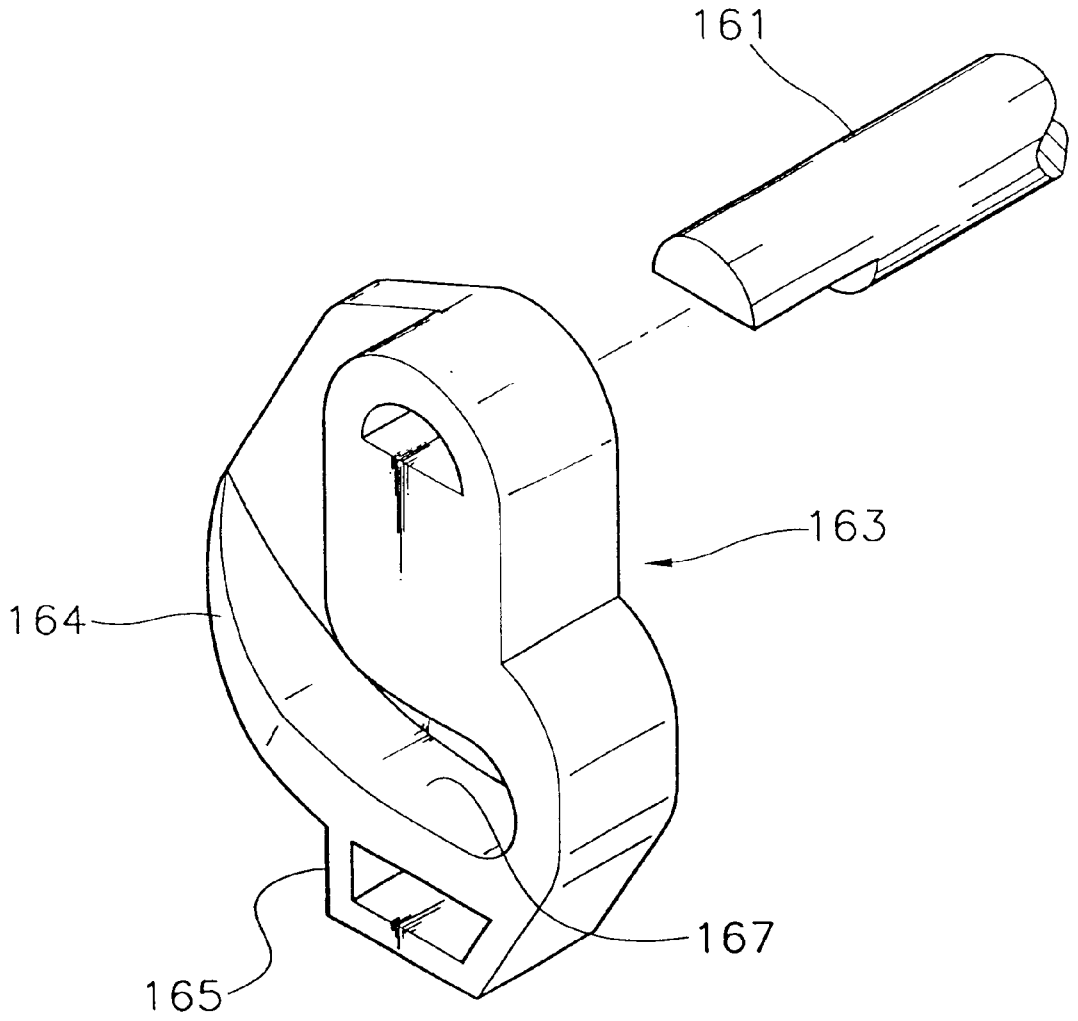
FIG. 5 is a perspective view showing the pivot member of FIG. 4.

The pivot unit 160 includes a support shaft 161 rotatably installed at the auxiliary frame 120, a pivot member 163 installed at the support shaft 161, and a handle lever 169. The pivot member 163 is installed at an end portion of the support shaft 161 to correspond to the slider 150. Also, the pivot member 163, as shown in FIG. 5, has an inclined surface 164 at one side thereof to push the slider 150 toward the driven gear 131 by contacting the slider 150 during pivoting. Also, a stopper portion 165 and a coupling groove 167 are formed to be stepped near the inclined surface 164 of the pivot member 163. The stopper portion 165 is hooked by one side of the slider 150, during pivoting, to limit the pivot range of the pivot member 163. A coupling pin 119 (see FIGS. 3–4 and 7–9) is coupled to the coupling groove 167 when the pivot member 163 pivots.

The handle lever 169 is fixed at about the middle portion of the support shaft 161. Also, the handle lever 169 is disposed in a handle lever installation portion 123 formed by penetrating the auxiliary frame 120, to be capable of pivoting with respect to the auxiliary frame 120. Thus, the support shaft 161 is rotated by manually rotating the handle lever 169. An elastic piece and a locking groove (not shown) are formed at the handle lever 169 and the handle lever installation portion 123, respectively, to elastically lock them together.

To prevent the position fixing bar 114 from deviating from the position determination hole 151, a posture fixing mechanism is further provided to fix the posture of the slider 150. The posture fixing mechanism includes a posture fixing hole 153 formed in the slider 150 to be adjacent to the position determination hole 151, and a posture fixing bar 121 installed at the auxiliary frame 120 to be slidably coupled to the posture fixing hole 153.

Also, a locking mechanism for locking the auxiliary frame 120 and the main frame 110 together when the pivot member 163 pushes the slider 150 toward the position fixing bar 114 and the position determination hole 151 to be coupled, is further provided. The locking mechanism includes a coupling pin 119 installed at the main frame 110, and a coupling groove 167 formed in the pivot member 163 to correspond to the coupling pin 119.

Figure 6:
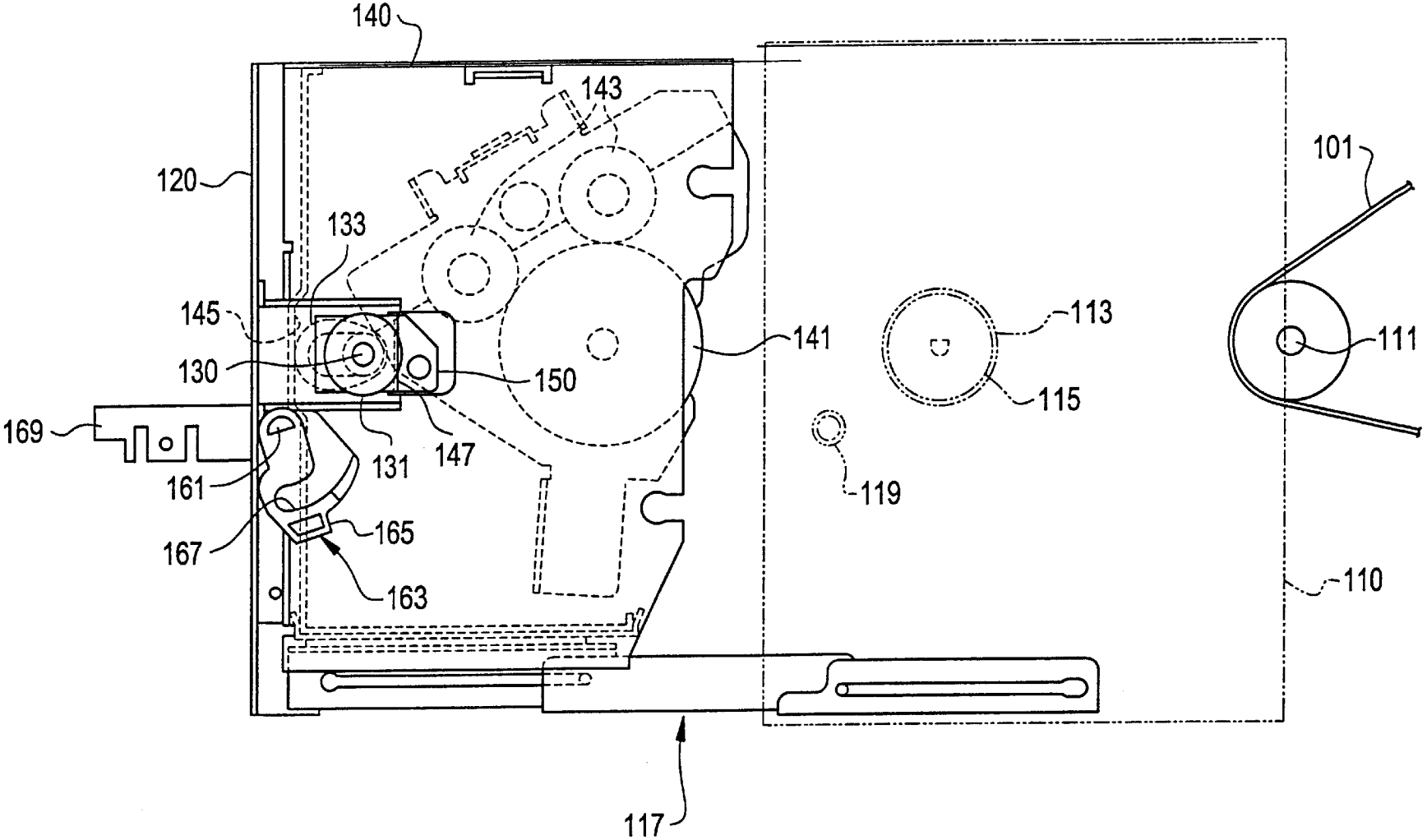
FIG. 6 is a front view showing the state in which the auxiliary frame is disassembled from the main frame in the operation of the drying unit coupling apparatus according to the present invention.
Figure 7:
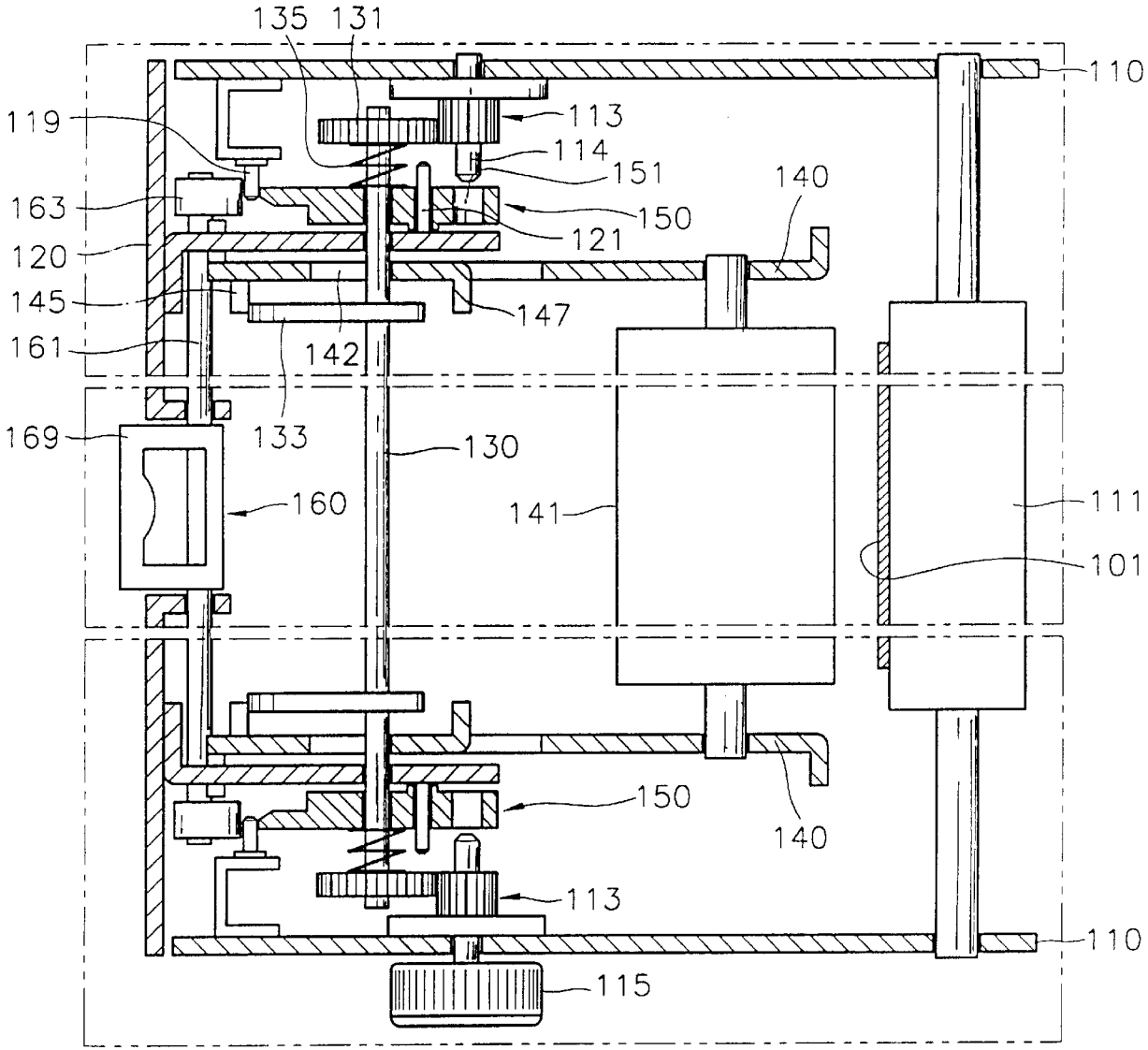
FIG. 7 is a sectional view showing the state in which the auxiliary frame is installed at the main frame.

In the operation of the drying unit coupling apparatus having the above structure, as shown in FIG. 6, in order to install the auxiliary frame 120 supported with the drying unit frame 140, by the rail assembly 117, at the main frame 110, the auxiliary frame 120 is pushed toward the main frame 110 using the handle lever 169. Then, as the rail assembly 117 moves telescopically, the auxiliary frame 120 is coupled to the main frame 110, as shown in FIG. 7. Also, the driven gear 131 and the driving gear 113 are engaged with each other. Here, the drying unit frame 140 is in a repairing mode, separated about 12 mm from the main frame 110.

Figure 8:
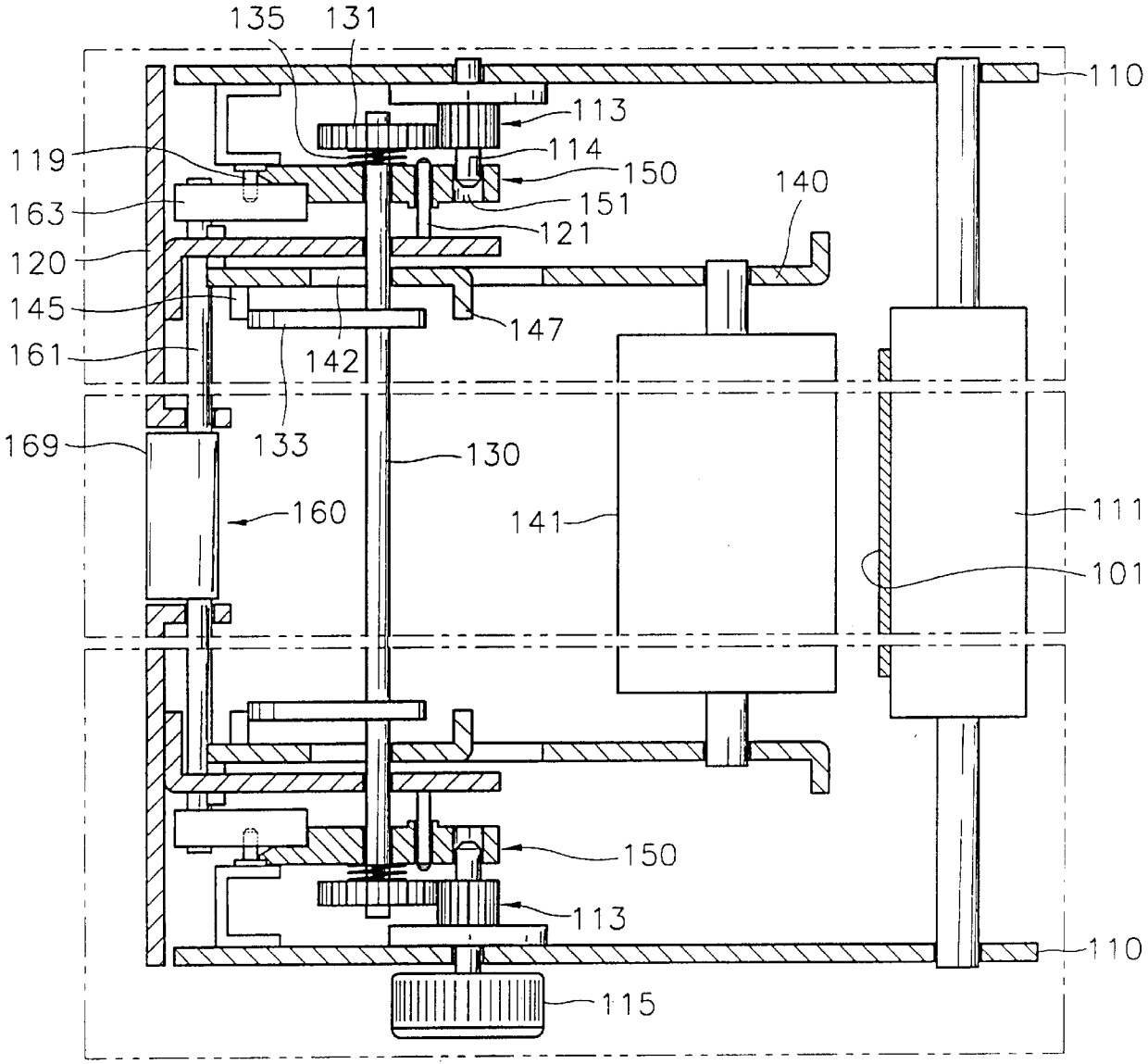
FIG. 8 is a sectional view showing the state in which the position of the cam shaft is fixed and the auxiliary frame and the main frame are locked together.

Under these circumstances, when the handle lever 169 is rotated somewhat downwardly, the pivot member 163 is rotated by a predetermined angle upward with the support shaft 161. Here, as the inclined surface 164 of the rotating pivot member 163 contacts and presses one side of the slider 150, the slider 150 is pushed toward the driven gear 131. When the handle lever 169 is completely rotated, the handle lever 169 is fixedly coupled to the handle lever installation portion 123, and the slider 150, one side hooked by the stopper portion 165, is completely moved toward the driven gear 131. Also, the position fixing bar 114, as shown in FIG. 8, is coupled to the position determination hole 151 and the position of the cam shaft 130 is fixed with respect to the driving gear 113. Thus, the state in which the driven gear 131 and the driving gear 113 are engaged with each other can be constantly maintained.

Figure 9:
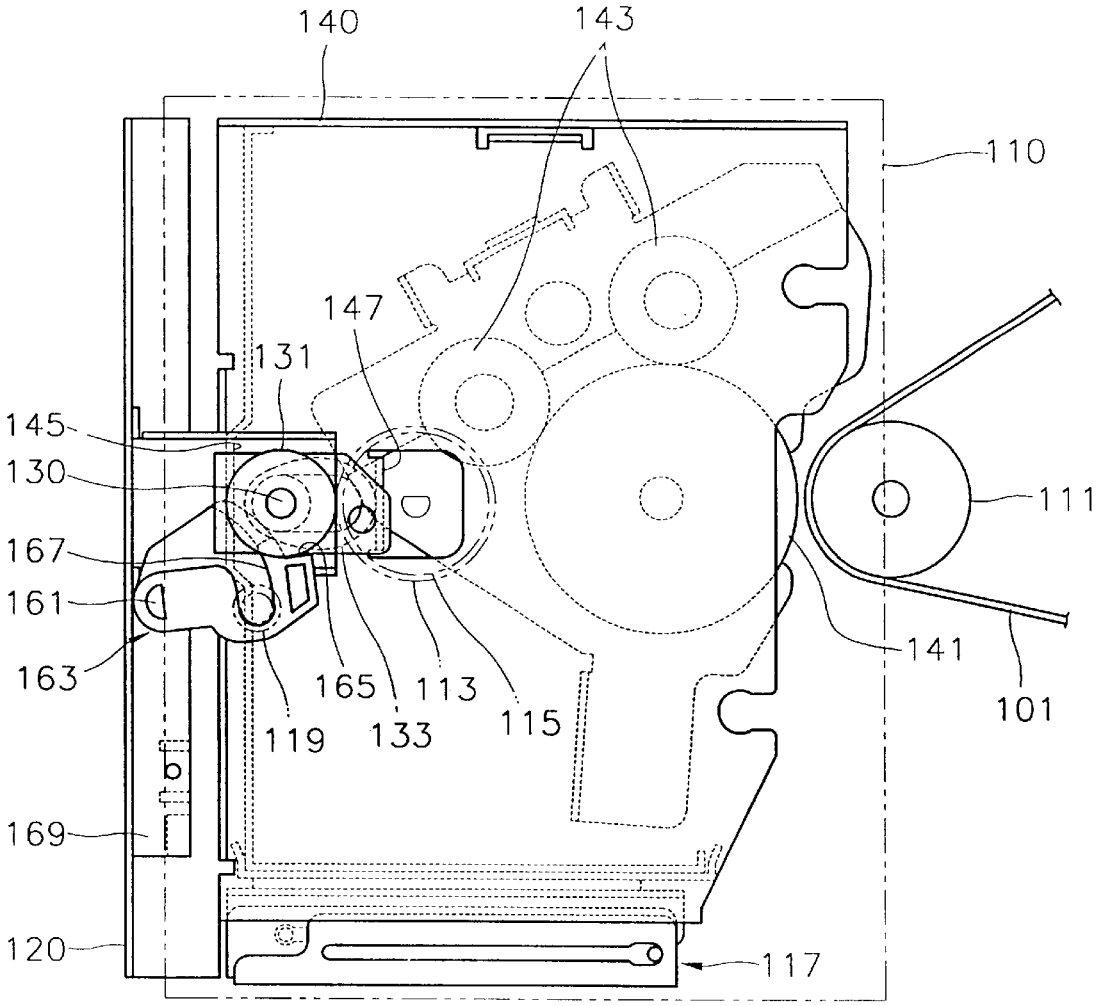
FIG. 9 is a front view showing the state in which the drying unit frame is in close contact with the main frame.

Also, while the pivot member 163 is rotated, as shown in FIG. 9, the coupling groove 167 is rotated and coupled to the coupling pin 119 so that the auxiliary frame 120 and the main frame 110 are completely coupled.

As described above, by rotating the handle lever 169 to be coupled to the handle lever installation portion 123, it is convenient that the operations of fixing the position of the cam shaft 130 and coupling the auxiliary frame 120 to the main frame 110 can be simultaneously performed.

When a user rotates the handle 115 through a predetermined angle in a state in which the auxiliary frame 120 and the main frame 110 are coupled, the driving gear 113 and the driven gear 131, being engaged with each other, are rotated. As the driven gear 131 is rotated, the cam shaft 130 and the cam member 133 rotate through a predetermined angle. Then, the portion of the major axis of the cam member 133 pushes the contact plate 147 toward the driving roller 111 so that the drying unit frame 140 closely contacts the main frame 110, as shown in FIG. 9. This state corresponds to a printing-ready mode or a printing mode, in which the drying unit frame 140 is separated about 3 mm from the main frame 110. In this state, the heating roller 143 closely contacts the drying roller 141 by means of an additional driving means (not shown) and the drying roller 141 is moved toward the driving roller 111 so as to contact the photoreceptor medium 101.

When the drying unit frame 140 and the auxiliary frame 120 are to be separated from the main frame 110, the installation operation described above is performed in reverse. Here, when the operation of turning the repairing mode to a printing-ready mode or a printing mode, or the reverse operation, is repeated, since the driving gear 113 and the driven gear 131 are completely engaged with each other in the state of the position of the cam shaft 130 being fixed, two gears 113 and 131 are normally engaged.

As described above, in the drying unit coupling apparatus of a liquid electrophotographic printer according to a preferred embodiment of the present invention, as a structure for fixing the position of the cam shaft 130 is provided, the state of engagement of the driving gear 113 and the driven gear 131 needed to rotate the cam shaft 130 can be constantly maintained. Thus, the cam shaft 130 can be accurately rotated through a desired angle and the drying unit frame 140 can be separated a desired predetermined distance from the main frame 110 so that the occurrence of an error or malfunction of the drying unit can be prevented.

Also, since the operations of fixing the position of the cam shaft 130 with respect to the driving gear 113 and of coupling the auxiliary frame 120 to the main frame 110 can be simultaneously performed by using the handled lever 169, an additional operation is not needed and printing work can be easily performed.

It is contemplated that numerous modifications may be made to the drying unit coupling apparatus of the present invention without departing from the spirit and scope of the invention as defined in the following claims.

What is claimed is:

1. A drying unit coupling apparatus of a liquid electrophotographic printer comprising:

a main frame where a driving roller for supporting a photoreceptor medium operative to circulate is supported;

a driving gear installed at the main frame;

a cam shaft supported at an auxiliary frame which is slidably installed at the main frame;

a drying unit frame where a drying roller for absorbing a liquid carrier remaining on the photoreceptor medium, a heating roller for heating the drying roller, and a separation plate and a contact plate are installed;

a driven gear installed at the cam shaft and engaged with the driving gear when the auxiliary frame and the main frame are coupled;

a cam member, installed at the cam shaft, for selectively pushing the separation plate or the contact plate so that the drying unit frame closely contacts or separates from the main frame; and a position fixing means for fixing the position of the cam shaft in a state of the driving gear and the driven gear being engaged, to prevent the driving gear and the driven gear from deviating from each other.

2. The apparatus as claimed in claim 1, wherein the position fixing means comprises:

a position fixing bar extended from a rotation shaft of the driving gear;

a slider, slidably installed at the cam shaft, having a position determination hole into which the position fixing bar is inserted; and a coupling/releasing means for coupling and releasing the position determination hole and the position fixing bar by selectively moving the slider.

3. The apparatus as claimed in claim 2, wherein the coupling/releasing means comprises:

a spring, installed at the cam shaft, for elastically pressing the slider so that the position determination hole is separated from the position fixing bar; and a pivot unit, pivotably installed at the auxiliary frame, for pushing the slider toward the position fixing bar so that the position determination hole and the position fixing bar are coupled to each other.

4. The apparatus as claimed in claim 3, wherein the pivot unit comprises:

a support shaft rotatably installed at the auxiliary frame;

a pivot member, fixed to the support shaft, having an inclined surface to contact the slider so as to push the slider toward the position fixing bar during rotation; and a handle lever, fixed to the support shaft and installed at a handle lever installation portion formed by penetrating the auxiliary frame to enable the handle lever to pivot with respect to the auxiliary frame.

5. The apparatus as claimed in claim 4, wherein the pivot member further comprises a stopper portion which limits a pivoting range of the pivot member by hooking one side of the slider.

6. The apparatus as claimed in claim 2, further comprising a posture fixing means for fixing slider posture to prevent the position fixing bar and the position determination hole from deviating from each other.

7. The apparatus as claimed in claim 5, wherein the posture fixing means comprises:

a posture fixing hole formed in the slider; and a posture fixing bar, installed at the auxiliary frame and slidably coupled to the posture fixing hole.

8. The apparatus as claimed in claim 3, further comprising a locking means for locking the auxiliary frame and the main frame together when the position fixing bar and the position determination hole are coupled to each other.

9. The apparatus as claimed in claim 8, wherein the locking means comprises:

a coupling pin installed to protrude from one side of the main frame; and a coupling groove, formed in the pivot unit and into which the coupling pin is inserted, the coupling groove pivoting when the pivot unit pivots by being coupled to the coupling pin.

10. A drying unit coupling apparatus of a liquid electrophotographic printer comprising:

a main frame;

a driving roller supported by said main frame;

a photoreceptor medium supported by said driving roller;

a driving gear installed at the main frame;

an auxiliary frame which is slidably installed at the main frame;

a cam shaft supported at the auxiliary frame;

a drying unit comprising:

a drying unit frame;

a drying roller which absorbs a liquid carrier remaining on the photoreceptor medium, a heating roller which heats the drying roller, and a separation plate and a contact plate, wherein the drying roller, the heating roller, the separation plate, and the contact plate are installed in the drying unit frame;

a driven gear installed at the cam shaft and engaged with the driving gear when the auxiliary frame and the main frame are coupled;

a cam member, installed at the cam shaft and selectively pushing the separation plate or the contact plate so that the drying unit frame closely contacts or separates from the main frame; and a position fixing mechanism which fixes the position of the cam shaft when the driving gear and the driven gear are engaged, preventing the driving gear and the driven gear from deviating from each other.

11. The apparatus as claimed in claim 10, wherein the position fixing mechanism comprises:

a position fixing bar extended from a rotation shaft of the driving gear;

a slider, slidably installed at the cam shaft;

a position determination hole, formed in said slider; and a coupling/releasing mechanism which couples and releases the position determination hole and the position fixing bar by selectively moving the slider, wherein said position fixing bar is inserted into said position fixing hole.

12. The apparatus as claimed in claim 11, wherein the coupling/releasing mechanism comprises:

a spring, installed at the cam shaft and elastically pressing the slider so that the position determination hole is separated from the position fixing bar; and a pivot unit, pivotably installed at the auxiliary frame and pushing the slider toward the position fixing bar so that the position determination hole and the position fixing bar are coupled to each other.

13. The apparatus as claimed in claim 12, wherein the pivot unit comprises:

a support shaft rotatably installed at the auxiliary frame;

a pivot member, fixed to the support shaft and having an inclined surface to contact the slider so as to push the slider toward the position fixing bar during rotation; and a handle lever, fixed to the support shaft and installed at a handle lever installation portion formed by penetrating the auxiliary frame to enable the handle lever to pivot with respect to the auxiliary frame.

14. The apparatus as claimed in claim 13, wherein the pivot member further comprises a stopper portion which limits a pivoting range of the pivot member by hooking one side of the slider.

15. The apparatus as claimed in claim 11, further comprising a posture fixing mechanism which fixes slider posture to prevent the position fixing bar and the position determination hole from deviating from each other.

16. The apparatus as claimed in claim 14, wherein the posture fixing mechanism comprises:

a posture fixing hole formed in the slider; and a posture fixing bar, installed at the auxiliary frame and slidably coupled to the posture fixing hole.

17. The apparatus as claimed in claim 12, further comprising a locking mechanism which locks the auxiliary frame and the main frame together when the position fixing bar and the position determination hole are coupled to each other.

18. The apparatus as claimed in claim 17, wherein the locking mechanism comprises:

a coupling pin installed to protrude from one side of the main frame; and a coupling groove, formed in the pivot unit and into which the coupling pin is inserted, the coupling groove pivoting when the pivot unit pivots by being coupled to the coupling pin.

* * * * *